United States Patent [19]

Burton et al.

[11] Patent Number: 4,605,195

[45] Date of Patent: Aug. 12, 1986

[54] ANNULAR BLOWOUT PREVENTER PACKING UNIT

[75] Inventors: James A. Burton, Houston; Kenneth W. Colvin, Humble; Julian D. Keithahn, Houston, all of Tex.

[73] Assignee: Hydril Company, Los Angeles, Calif.

[21] Appl. No.: 729,179

[22] Filed: May 1, 1985

[51] Int. Cl.[4] ..... E21B 33/06

[52] U.S. Cl. ..... 251/1.2; 277/121

[58] Field of Search ..... 251/1.1, 1.2; 277/116.2, 117–122, 235 R

[56] References Cited

U.S. PATENT DOCUMENTS

| | | | |
|---|---|---|---|
| 2,038,140 | 4/1936 | Stone | 277/34.3 |
| 2,124,015 | 7/1938 | Stone et al. | 277/73 |
| 2,148,844 | 2/1939 | Stone et al. | 277/73 |
| 2,163,813 | 6/1939 | Stone et al. | 277/2 |
| 2,287,205 | 6/1942 | Stone | 277/28 |
| 2,609,836 | 9/1952 | Knox | 137/618 |
| 3,255,831 | 12/1965 | Knox | 166/75 |
| 3,323,773 | 6/1967 | Walker | 251/1.2 |
| 3,486,759 | 12/1969 | Lewis | 277/73 |
| 3,533,468 | 10/1970 | Lewis | 166/0.5 |
| 3,572,627 | 3/1971 | Jones | 251/1.2 |
| 3,591,125 | 7/1971 | Lewis | 251/1.2 |
| 3,897,040 | 7/1975 | Le Rouax | 251/1.1 |
| 3,917,293 | 11/1975 | Lewis et al. | 277/114 |
| 3,958,808 | 5/1976 | Lewis et al. | 277/1 |
| 3,994,472 | 11/1976 | Williams | 251/1.2 |
| 4,007,904 | 2/1977 | Jones | 251/1.2 |
| 4,098,341 | 7/1978 | Lewis | 166/314 |
| 4,098,516 | 7/1978 | Murman | 277/235 R |
| 4,229,012 | 10/1980 | Williams, III | 277/127 |
| 4,283,039 | 8/1981 | Schaeper et al. | 251/1.2 |
| 4,310,139 | 1/1982 | Williams, III et al. | 251/1.2 |
| 4,447,037 | 5/1984 | Huey et al. | 251/1.2 |
| 4,452,421 | 6/1984 | Huey et al. | 251/1.2 |
| 4,461,448 | 7/1984 | Huey et al. | 251/1.2 |

*Primary Examiner*—Samuel Scott
*Assistant Examiner*—Allen J. Flanigan
*Attorney, Agent, or Firm*—Dodge, Bush & Moseley

[57] ABSTRACT

An annular blowout preventer packer unit is disclosed having an annulus of elastomeric material in which is embedded metallic drive inserts provided in an outward circle about the axis. Metallic lead inserts are provided in an inward circle about the axis. The top and bottom plates of the drive inserts have two angled longitudinal forward surfaces which interface with reverse angled adjacent longitudinal rearward surfaces of the top and bottom plates of the lead inserts, respectively. When the BOP piston is closed, the drive inserts cause the lead inserts to advance inwardly a greater radial distance than the advance of the drive inserts. The result is that less stroke may be required to close the blowout preventer, and a controlled, predictable, uniform movement of the lead inserts is achieved. The drive inserts top plates are broad across their rearward longitudinal surface operably covering the area behind the lead inserts on closure of the packer unit. The shape of the drive inserts allows the lead inserts to be driven to a smaller diameter without opening up the back side and causing outer diameter elastomer loss to the unit.

15 Claims, 17 Drawing Figures

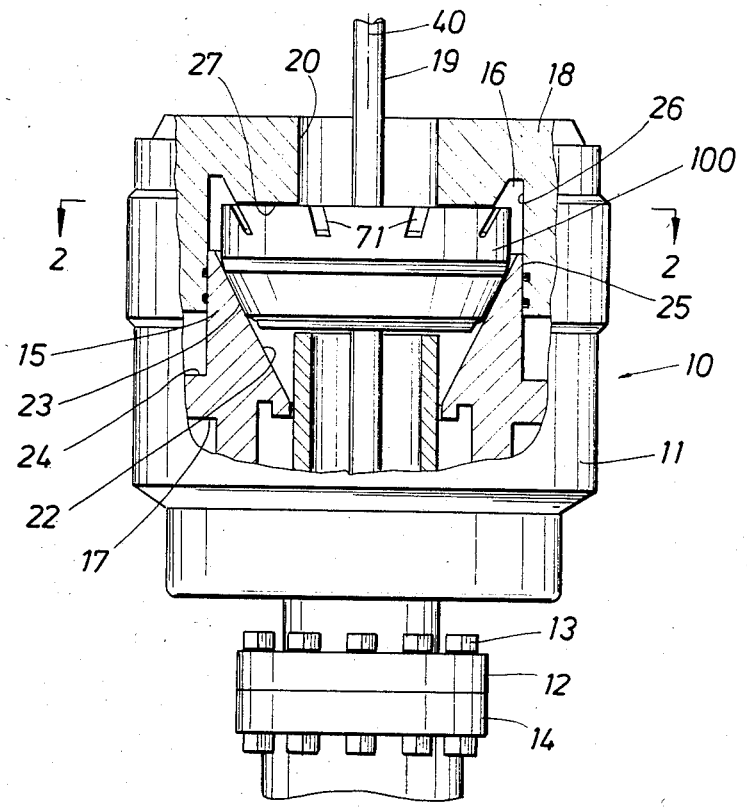
FIG. 1
FIG. 2
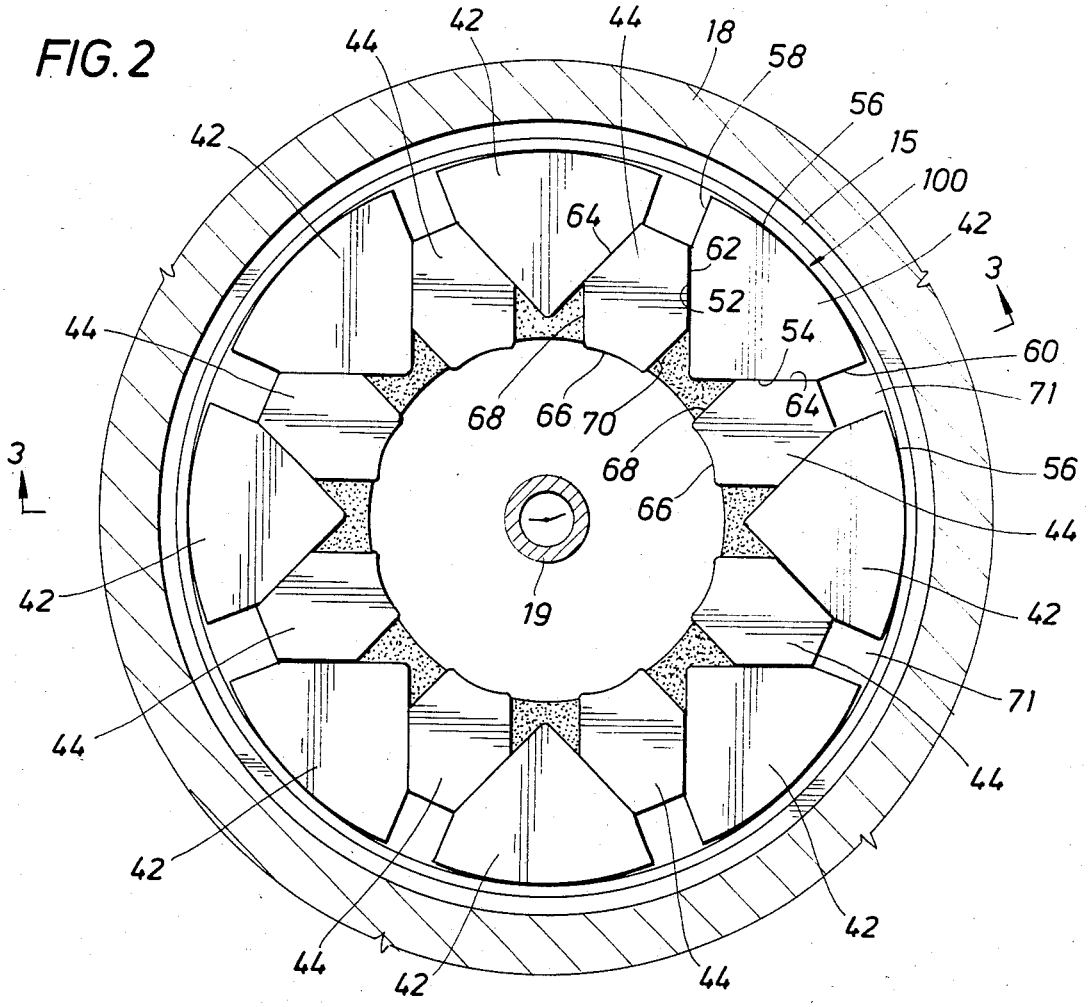

Ø = 90°
1.85
r1
360°/N
66
L
44
64
D
54
62
42
r1
58
60
56
54
70
66
68
Ø
52
62
64
42
56
44
60
58
42
42
72
52
56

Ø = 150°
1.22
r2
66'
L'
44'
54'
D'
64'
62'
42'
r2
58'
60'
72'
56'
42'
56'
44'
66'
52'
Ø
62'
64'
54'
58'
60'
42'
56'
42'
56'
52'

FIG. 7
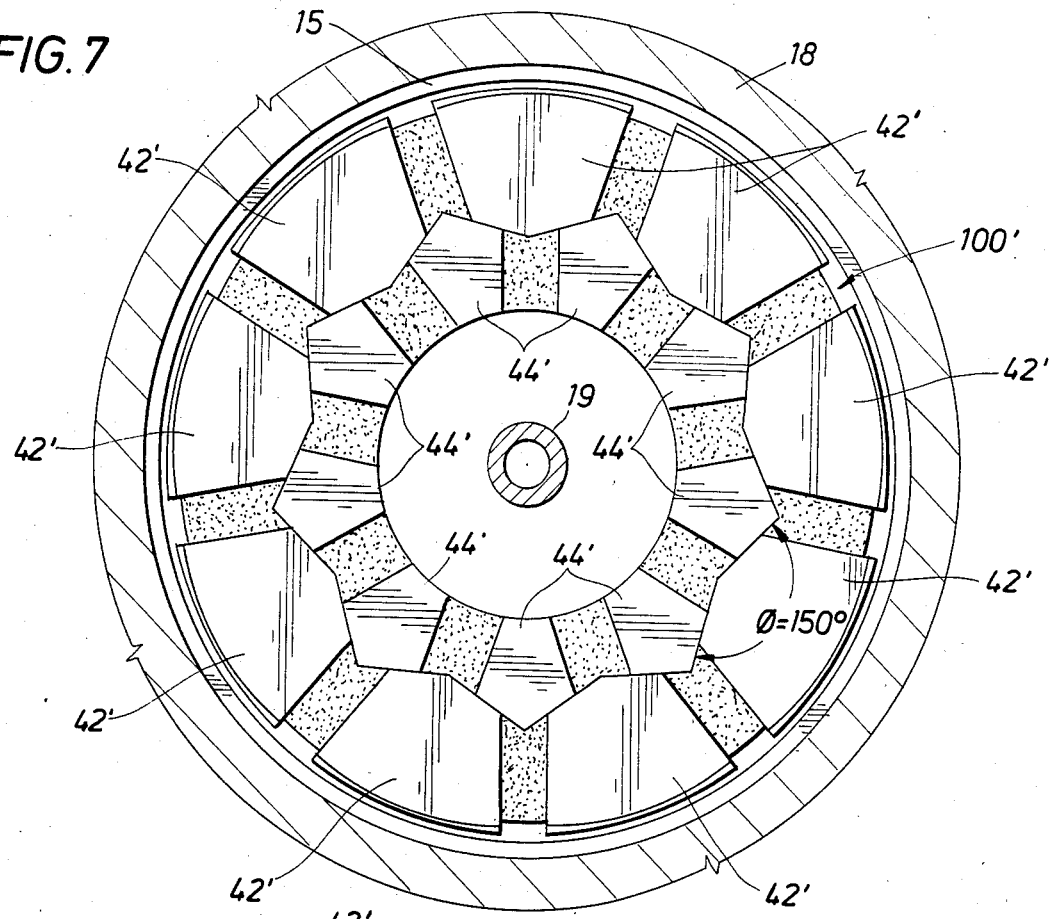
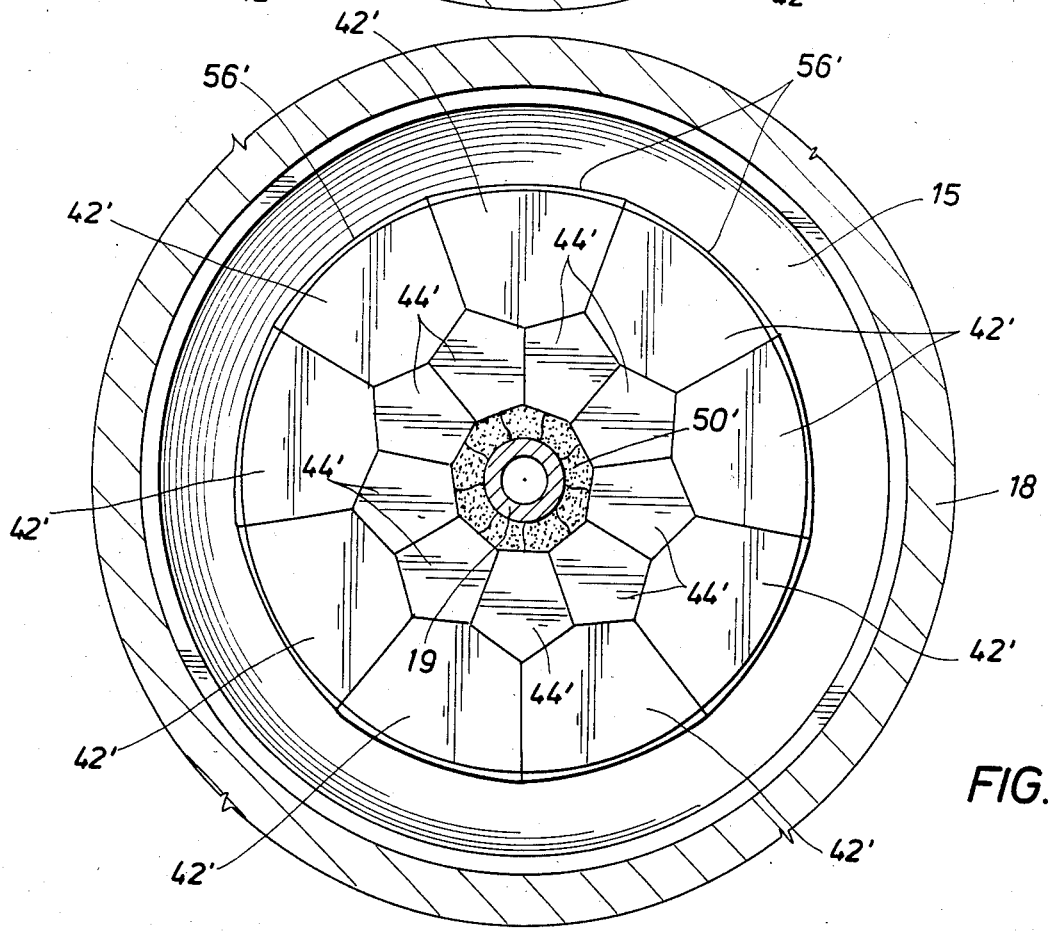
FIG.8

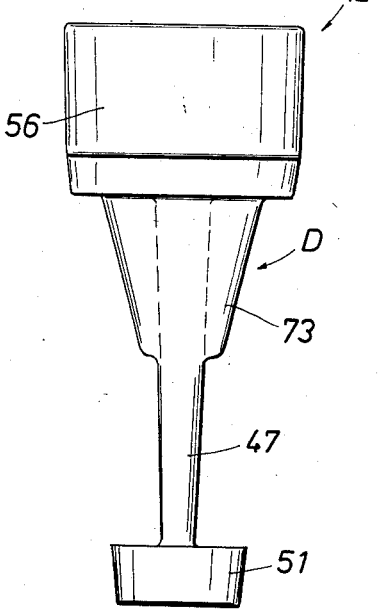
FIG. 10
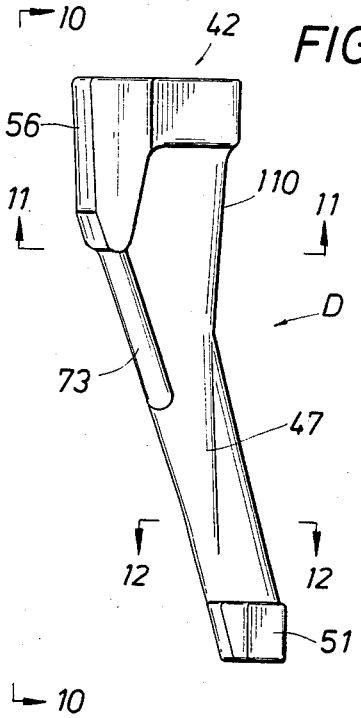
FIG. 9
FIG. 11
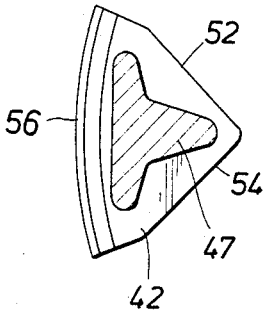
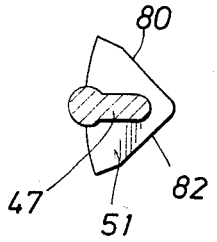
FIG. 12
FIG. 14
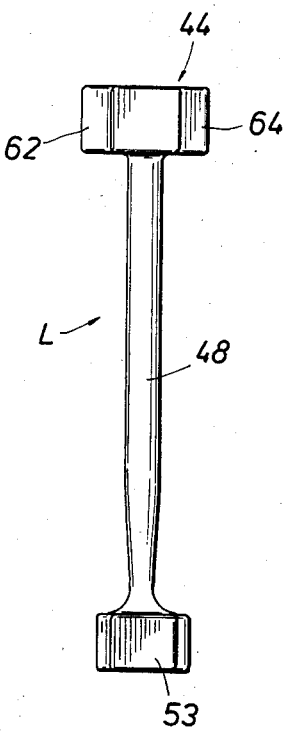
FIG. 13
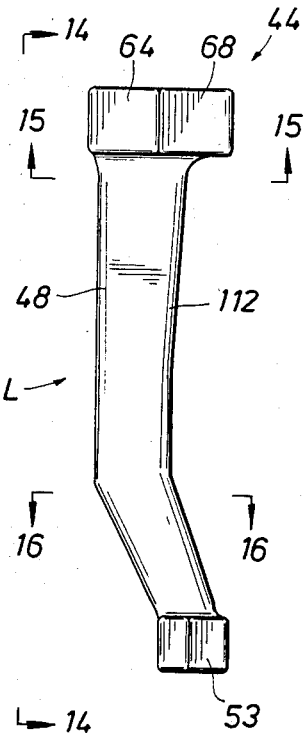
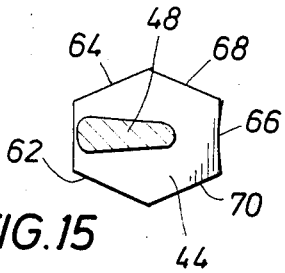
FIG. 15
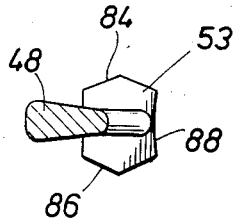
FIG. 16

ANNULAR BLOWOUT PREVENTER PACKING UNIT

BACKGROUND OF THE INVENTION

1. Field of the Invention

This invention relates generally to well blowout preventers and in particular to annular blowout preventers. More particularly the invention relates to packer units for annular blowout preventers.

2. Description of the Prior Art

For many years the design of annular blowout preventer packing units has followed the principles described in U.S. Pat. No. 2,609,836 to Knox. The terms packer unit, packing unit, packer are used interchangeably in this specification to mean the element in the annular blowout preventer which is annularly constricted about a pipe or other object in the vertical flow path of the annular blowout preventer and which is preferably adapted to completely shut off the vertical flow path even when no pipe or object is in the vertical flow path. Such units incorporate identical metal inserts equally spaced about the packer's central axis and embedded by an elastomeric material. Upon inward constriction or closure of the packer about a well drill pipe the packer closes the annulus between the drill pipe and the annular blowout preventer. The material is anchored by insert webs as it produces vertical folds stretching radially inwardly to seal against the pipe. The Knox patent is incorporated herein for all purposes.

U.S. Pat. No. 3,917,293 to Lewis and Murman provides differential anchoring of the inserts about the packer axis in the elastomeric material with the improvement of longer cycle life for the packing unit. Cycle life is defined as the number of closures before failure that the packing element may make either on a well pipe in the annulus of the packing unit or in the absence of a well pipe. The Lewis and Murman patent shows lead inserts and lag inserts whereby on closure the lead inserts move radially inwardly to form a near solid metallic wall about the axis of the preventer. The elastomeric material of the packing unit below such wall extrudes inwardly toward a well pipe or other object in the annulus or to completely close off the annulus in the absence of such well pipe or other object. U.S. Pat. No. 3,917,293 is likewise incorporated herein for all purposes.

The annular packing unit described in the Lewis and Murman patent significantly increases the packer cycle life over that of the packer illustrated in the Knox patent described above. The primary purpose of the packing unit which is the subject of this invention and as described below is to make further improvements in cycle life and in operational characteristics over previously known packing units.

IDENTIFICATION OF OBJECTS OF THE INVENTION

It is therefore an object of the invention to provide an annular packing unit in which the top and bottom plates of lead inserts at complete shut off about a pipe create a substantially solid metallic annular wall only a small radial distance greater than the largest radial dimension of a pipe or other object intended to pass through the unit.

It is another object of the invention to minimize the outer annulus between the packer inserts and the closing BOP piston in order to reduce as much as possible elastomeric loss caused by the force of the piston about the exterior of the packing unit.

It is another object of the invention to minimize elastomeric loss on the outside of the packer by containing the elastomer inside the packing unit within the top and bottom plates of drive inserts embedded in the elastomeric material.

It is another object of the invention to minimize the loss of annular blowout preventer stroke which is directly related to loss of rubber so as to increase cycle life of the packing unit.

It is another object of the invention to produce a more dependable and durable packing unit.

SUMMARY OF THE INVENTION

The above objects of the invention and other advantages and features are provided by an annular blowout preventer packing unit having a longitudinal axis and which is adapted to be compressed radially inwardly from a relaxed state to a closing state. The packer unit includes an annulus of elastomeric material and metallic drive inserts and lead inserts embedded in the elastomeric material.

The metallic drive inserts are generally circularly embedded in the elastomeric material about the axis of the packer unit. Each of the drive inserts has a web which extends generally longitudinally and has a top plate with two longitudinal forward surfaces and a longitudinal back surface. The two longitudinal forward surfaces are equally inclined with respect to a longitudinal plane along a radius through the center of a drive insert. The angle between the two longitudinal forward surfaces is called the drive angle.

The lead inserts are likewise embedded in the elastomeric material generally circularly about the axis of the packing unit. Each of the inserts has a web which extends generally longitudinally and has a top plate with two longitudinal rear surfaces and a longitudinal forward surface. The longitudinal rear surfaces are equally inclined with respect to a longitudinal plane through a radius through the center of the lead insert.

The drive inserts and the lead inserts are arranged with respect to each other so that at least partial engagement exists between each forward surface of the top plate of a drive insert and the rear surface of the top plate of an adjacent lead insert in the relaxed state of the packer unit. When the BOP piston is forced upwardly in the BOP housing, the drive insert forces the lead insert to advance by the drive angle interface and the exaggerated offset of the two adjacent rear surfaces of the lead insert top plates. This produces a controlled, predictable, uniform movement of the lead inserts.

The drive inserts are broad across the back on their outside diameter covering the area behind the lead inserts. This allows the lead inserts to be driven in to a smaller diameter without opening up the backside and causing outside diameter damage to the packing unit.

The drive angle between the two longitudinal forward surfaces of the top plate of the drive inserts may be selected to cause continuous partial engagement between each forward surface of the top plate of a drive insert and the rear surface of the top plate of an adjacent lead insert between the relaxed state of the packer unit and the closing state of the packing unit. The drive angle $\phi$ between the two longitudinal forward surfaces of the top plate of the drive inserts and a second angle $\alpha$ between the two longitudinal rear surfaces of the top plate of the lead inserts is related by the equation $$\phi = \alpha + \frac{360°}{N},$$

where N is the number of drive inserts.

Where N=8 and $\phi$ is selected to be about 90°, the longitudinal forward surfaces of the top plate of the drive inserts are in continuous partial engagement with the rear surfaces of the top plate of an adjacent lead insert between the relaxed state of the packer unit and a closing state of the packing unit. The lead insert moves radially inwardly approximately 1.85 times as much as does the drive insert during closure of the packing unit. The rapid movement of the lead insert with respect to the drive insert requires less stroke to close the packing unit. Less stroke of the packing unit allows an annular blowout preventer to be designed with minimum height.

Where N=8 and $\phi$ is selected to be about 150°, the longitudinal forward surfaces of the top plate of the drive inserts become disengaged with the rear surface of the top plate of an adjacent lead insert between the relaxed state of the packer unit and the closing state of the packer unit. The lead insert moves radially inwardly approximately 1.22 times as much as does the drive insert during closure of the packer unit.

The curved rearward longitudinal surface of the top plate of the drive inserts is approximately $$\frac{2\pi}{N}$$

times the outer radius of the top plate of the drive insert of the packer unit on complete closure, where N is the number of drive inserts in the packer unit. When the packer unit is completely closed only a small gap exists between adjacent rearward longitudinal surfaces operably substantially preventing rearward extrusion of elastomeric material through the drive insert top plates of the packing unit during closure.

Each of the top plates of the drive inserts has two longitudinal side surfaces. The side surfaces connect one end of the rearward curved surface with one of the inclined forward surfaces whereby when the packer unit is completely closed, only a small gap exists between adjacent side surfaces of the drive inserts operably substantially preventing upward elastomeric extrusion between the top plates of the drive inserts.

The curved forward surface of the top plate of the lead insert is approximately $$\frac{2\pi}{N}$$

times the inner radius of the top plate of the lead insert of the packer unit on complete closure, where N is the number of lead inserts in the packer unit. When the packer unit is completely closed, only a small gap exists between adjacent forward longitudinal surfaces operably substantially creating a solid metallic wall about the longitudinal axis of the packer unit. Such solid metallic wall prevents radial extrusion of elastomeric material through the lead insert top plates and provides better elastomeric support to resist borehole pressure.

Each of the top plates of the lead inserts have two longitudinal side surfaces. Each side surface connects one end of the forward curve surface with one of the inclined longitudinal rearward surfaces. When the packer unit is completely closed, only a small gap exists between the adjacent side surface of the lead inserts operably substantially preventing upward elastomeric extrusion between the top plates of the lead insert.

The drive inserts have a bottom plate with two longitudinal forward surfaces. The two longitudinal forward surfaces are equally inclined with respect to the longitudinal plane along the radius through the center of the drive insert. The angle between the two longitudinal forward surfaces of the bottom plate is called the drive angle.

Each of the lead inserts has a bottom plate with two longitudinal rearward surfaces and a longitudinal forward surface. The two longitudinal rearward surfaces are equally inclined with respect to the longitudinal plane through the radius through the center of the lead insert.

The drive inserts and the lead inserts are arranged with respect to each other so that at least partial engagement exists between each forward surface of the bottom plate of the drive insert and the rear surface of an adjacent lead insert in the relaxed state of the packer unit.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which;

FIG. 1 is an elevation drawing, partly in section, showing use of the new packer;

FIG. 2 is an enlarged horizontal section taken on lines 2—2 of FIG. 1 and shows the packer unit in an opened or relaxed state;

FIG. 7 shows the packer unit constructed similarly to the design of FIG. 6 in which the angle $\phi$ is approximately 150° and showing the packer unit in an opened state;

FIG. 8 is an illustration of the packer unit of FIG. 7 in a closed state and packing off about a well pipe in the well bore;

FIG. 9 shows a side view of a drive insert;

FIG. 10 shows a rear view of the drive insert taken along lines 10—10 of FIG. 9;

FIG. 11 is a cross section looking upwardly through the drive insert along lines 11—11 of FIG. 9;

FIG. 12 is a cross section looking downwardly along lines of 12—12 of FIG. 9;

FIG. 13 is a side view of the lead insert;

FIG. 14 is a rear view of the lead insert looking inwardly along lines 14—14 of FIG. 13;

FIG. 15 is a cross section looking upwardly along lines 15—15 of FIG. 13;

FIG. 16 is a cross section looking downwardly along 16—16 of FIG. 13; and

DESCRIPTION OF THE INVENTION

Figure 3:
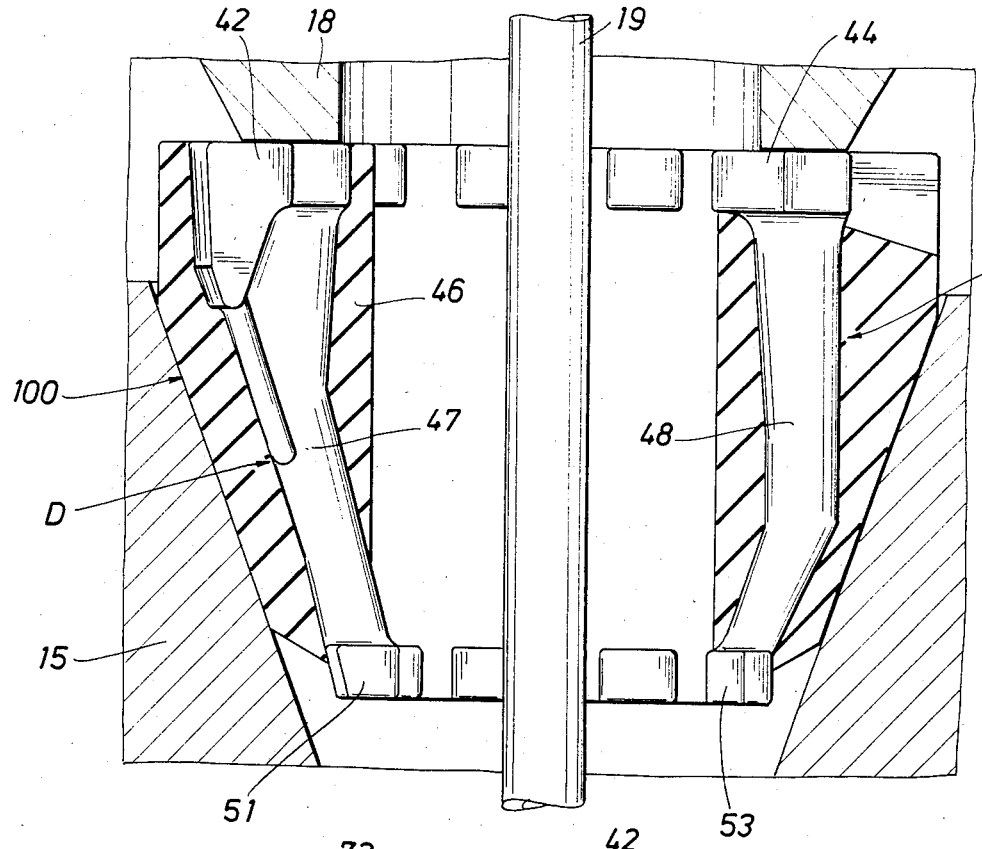
FIG. 3 is a vertical section on lines 3—3 of FIG. 2.

In FIG. 1 a blowout preventer 10 includes a metallic housing 11, the lower most extent of which is flanged at 12 and bolted at 13 to well casing flange 14 or other wellhead equipment. The housing 11 contains a piston 15 moveable upwardly in chamber 16 in response to fluid pressure exertion upwardly against piston face 17. Annular packing unit 100 is constricted, according to the invention, via pressure exertion from piston cam surface 22 against the packer exterior surface 23. Surfaces 22 and 23 are frusto-conical and flared upwardly.

The packing unit 100 according to the invention, when sufficiently radially inwardly displaced, seals off about well pipe 19 shown extending axially vertically through the annular preventer 10. In the absence of the well pipe 19, the packing unit 100 will completely close off the vertical passage 20 through the preventer when the packing unit is sufficiently constricted by piston 15. Upon downward movement of the piston in response to fluid pressure exertion against surface 24, the packer expands radially outwardly to the opened or relaxed state seen in FIG. 1.

The piston annular surface 25 may have guided sliding engagement with housing cap bore 26. The packer unit 100 is normally confined vertically under the housing cap lower interior surface 27.

Figure 17:
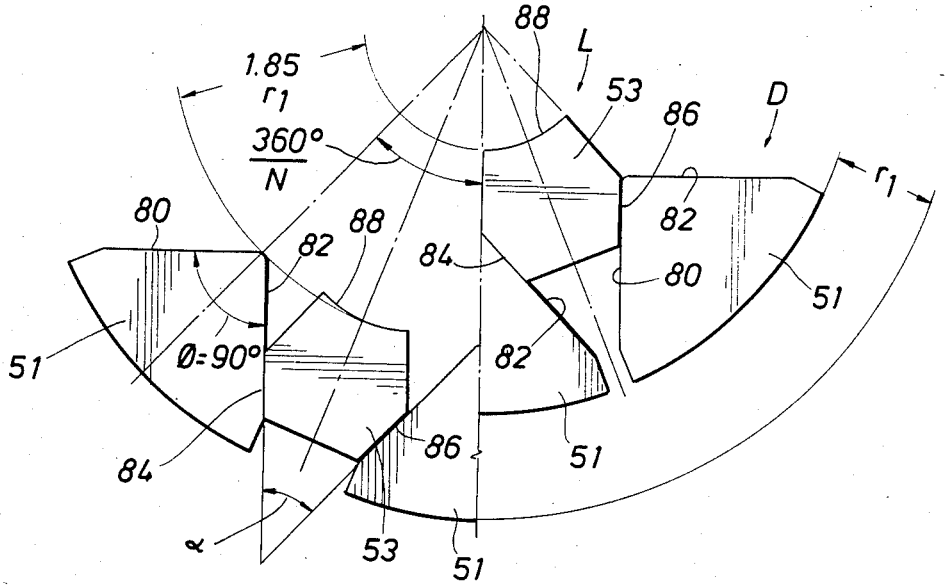
FIG. 17 is a schematic drawing showing the relationship between the drive angle $\phi$ of the bottom plate of the drive insert and the lead angle $\alpha$ of the bottom plate of the lead insert and showing the relationship between such inserts in the relaxed state and the closed state.

FIG. 2 illustrates a cross-section of the packer unit 100 in a relaxed state within the housing cap 18. FIG. 3 is a cross section taken along lines 3—3 of FIG. 2 and illustrates a side view of a drive insert D and a lead insert L embedded in elastomeric material 46. The drive inserts D are equally circularly spaced about the annular packing unit 100 and have top plates 42 as illustrated in FIG. 2 and bottom plates 51 as best illustrated in FIG. 17. The lead inserts L are also circularly arranged in the packer unit 100 and have top plates 44 engaging the top plates 42 of the drive inserts D as illustrated in FIG. 2. The lead inserts L also have bottom plates 53 engaging the bottom plates 51 of the drive inserts, as illustrated in FIG. 17.

In the open state of packer 100, as illustrated in FIG. 2, the forward longitudinal surfaces 52, 54 of top plates 42 of the drive inserts D are in engagement with the rearward longitudinal surfaces 62, 64 of adjacent top plates 44 of lead inserts L. The top plates 42 of the drive inserts D also have a curved longitudinal back surface 56 to be described in more detail with respect to FIGS. 9 and 10.

Two side longitudinal surfaces 58, 60 connect the forward longitudinal surface 52 and one end of the back longitudinal surface 56 and the longitudinal forward surface 54 with the other end of the longitudinal back surface 56. Likewise, the top plates 44 of the lead inserts L have a curved longitudinal forward surface 66 and side surfaces 68, 70 which connect the longitudinal rear surfaces 64 and 62 with the curved longitudinal forward surface 66. Cut outs 71 of elastomeric material are provided in the gaps between the rear surfaces 56 of the top plates of the drive inserts as seen in FIGS. 1 and 2.

Figure 4:
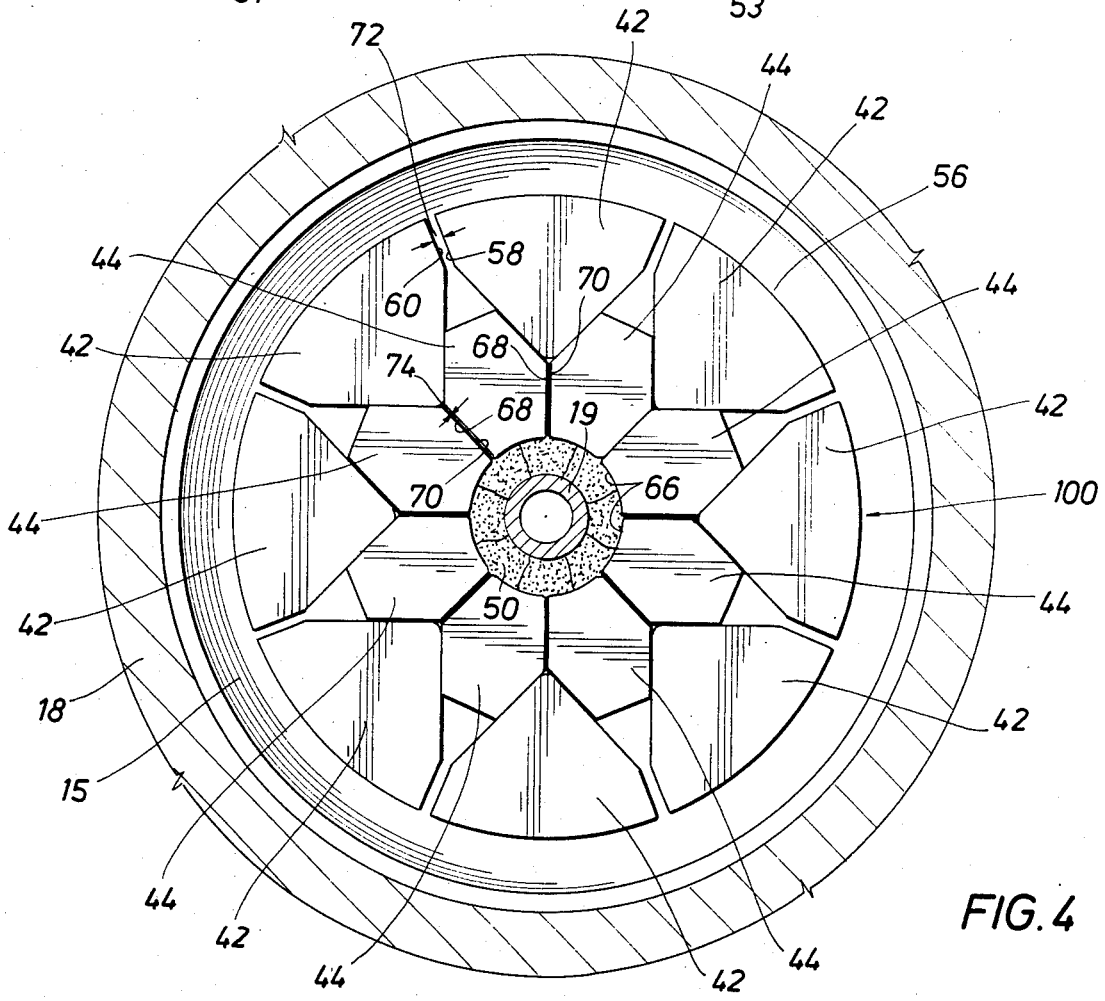
FIG. 4 is a section similar to that of FIG. 2 and shows the packing unit in a closed state about a well pipe extending through the vertical passage of the blowout preventer.

FIG. 4 illustrates the state of the packing unit after piston 15 has moved upwardly thereby inwardly constricting the packing unit 100 according to the invention. As illustrated in FIG. 4 the lead insert top plate 44 have moved inwardly to a position such that the curved forward longitudinal surfaces 66 of each lead insert approximately forms a closed cylindrical surface about the well pipe 19. Likewise, the longitudinal rear surfaces 56 of the top plates 42 of the drive inserts D have moved inwardly to form an approximately cylindrical outer surface at the top of the packing unit 100. The folds 50 of the elastomeric material 46 of the packing unit have moved inwardly to close the annulus about the well pipe 19. The elastomeric material will completely close the annulus even in the absence of a well pipe 19 or other object in the vertical flow path of the annular packer 100.

In a similar fashion, the bottom plates 51 of drive insert D move inwardly upon the upward movement of piston 15 to inwardly constrict the packing unit 100 according to the invention. The bottom plates 51 of the drive inserts D move the bottom plates 53 of lead inserts L, as best shown in FIG. 17, to form a closed cylindrical surface about the well pipe 19. The elastomeric material 46 proximate the bottom plates 51 and 53 moves inwardly to close the annulus about the well pipe 19 similar to the top plates. The elastomeric material proximate the bottom plates 51 and 53 will completely close the annulus even in the absence of a well pipe 19 or another object in the vertical flow path of the annular packer 100.

Figure 5:
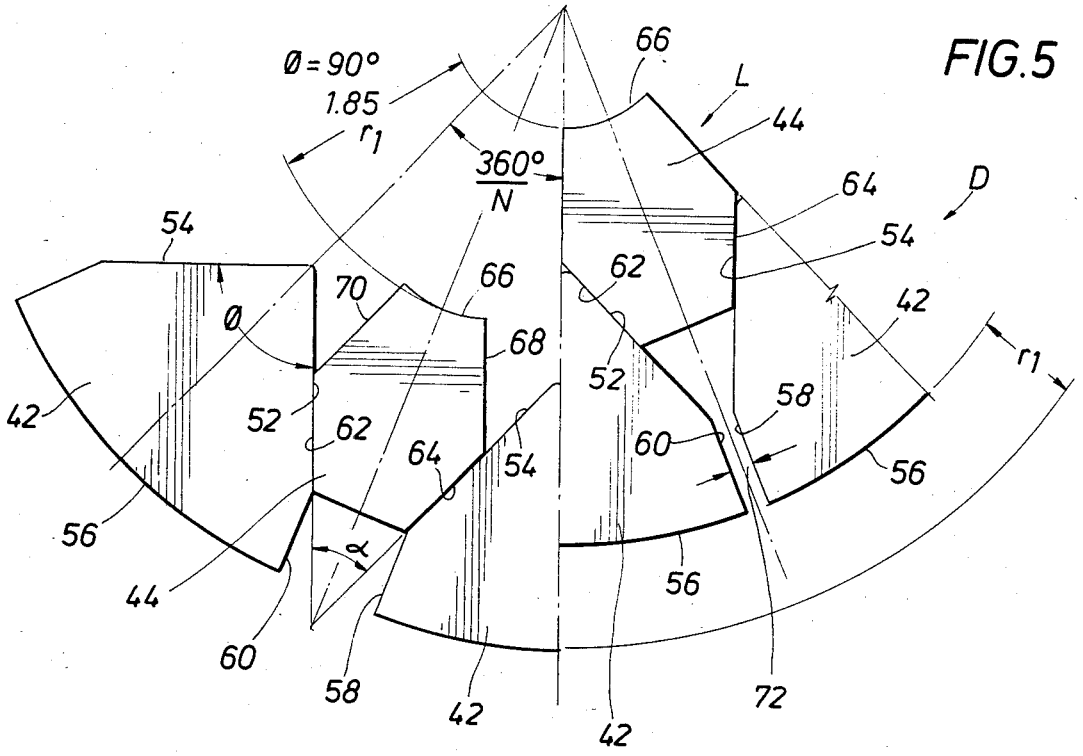
FIG. 5 is a schematic drawing showing the relationship between the drive angle $\phi$ of the top plate of the drive insert and the lead angle $\alpha$ of the top plate of the lead insert and showing the relationship between such inserts in the relaxed state and the closed state.

FIG. 5 illustrates the relationship between the top plates 42 of the drive inserts and the top plates 44 of the lead inserts. The drive angle $\phi$ between the forward surfaces 52 and 54 of the top plate 42 is approximately 90°. The relationship between drive angle $\phi$ and lead angle $\alpha$, the angle subtended by extensions of the rearward surfaces 62 and 64 of the top plate 44 is $$\phi = \alpha + \frac{360°}{N},$$

where N is the number of drive inserts provided in the packer unit 100. If N is equal to 8 units, and $\phi$ equals 90°, $\alpha$ is 45°.

The illustration of FIG. 5 shows the condition of the packer unit in its closed state on the right hand side of the Figure. The rear surfaces 62 and 64 of the top plate 44 of the lead insert are driven inwardly by surfaces 52 and 54 of the top plate 42 of the drive insert, respectively. The top plates 42 have moved radially inwardly a distance $r_1$ under the influence of the annular blowout preventer piston 15 (FIG. 1). The top plate 44 of the lead insert has moved 1.85 times $r_1$ indicating that a relatively rapid movement inward of the lead insert is achieved. As shown in FIG. 17, the bottom plates 51 also have been moved radially inwardly a distance $r_1$ under the influence of piston 15 (FIG. 1). The bottom plates 53 of the lead inserts have also been moved 1.85 times $r_1$, the same as top plate 44.

Also apparent from FIG. 5 is the continuous engagement of surfaces 52 and 62 and surfaces 54 and 64. One advantage of the rapid inward movement of the lead insert L is that relatively less stroke is required of the piston 15 to drive the lead insert L and its top and bottom plates to their closed state. A result of such advantage is that an annular blowout preventer may be designed to be of relatively shorter height because of the rapid inward movement of the lead insert L. A relatively shorter height for annular blowout preventers is advantageous because limited head room exists between the wellhead and the drilling rig floor for many drilling rigs.

Another advantage shown in FIG. 5 is, when $\phi$ is approximately 90°, continuous engagement of the forward surfaces 52, 54 of top plate 42 with the rearward surfaces 62 and 64 of the top plate 44 of the lead insert between the open state shown on the left and the closed state on the right. Such a continuous engagement produces a controlled predictable uniform inward movement of the lead inserts. In a similar fashion, the continuous engagement of forward surfaces 80, 82 and rearward surfaces 84, 86 (FIG. 17) between the open and closed state produces a controlled predictable uniform movement.

Another advantage evident from the illustrations of FIGS. 5 and 17 is that the top plate 44 and bottom plate 53 of lead inserts L can be made to move to a very small radius from the central axis of the blowout preventer. The small radius essentially solid metallic wall of lead insert top plate forward surfaces 66 and bottom plate forward surfaces 88 about the largest part of a drill string, for example, through the blowout preventer provides better elastomer support to resist bore pressure when the packing unit is closed.

FIG. 5 shows that the outer radius of the rear surfaces 56 of the top plates 42 of the drive inserts D extend substantially completely around the arc distance of $$\frac{2\pi}{N},$$

where N is equal to the number of drive inserts, times the outer radius of the top plate of the drive insert of the packer unit on complete closure. In other words, as shown on the right hand side of FIG. 5, a relatively complete metallic surface is provided around the periphery of the blowout preventer at closure. Only a small gap exists between adjacent rearward longitudinal surfaces 56, thereby substantially preventing rearward extrusion of elastomeric material through the drive insert top plates of the packing unit 100 during closure.

Likewise, the side surfaces 60 and 58 move together whereby only a small gap 72 exists on complete closure. The small gap 72 substantially prevents upward elastomeric extrusion between the top plates 42 of the drive inserts D. Likewise, as shown in FIG. 4, a very small gap exists between side surfaces 68 and 70 of the top plates 44 of the lead inserts L thereby preventing upward extrusion of elastomeric material on closure of the packing unit 100. The bottom plates 51 and 53 operate in a similar fashion to prevent extrusion of elastomeric material 46.

Figure 6:
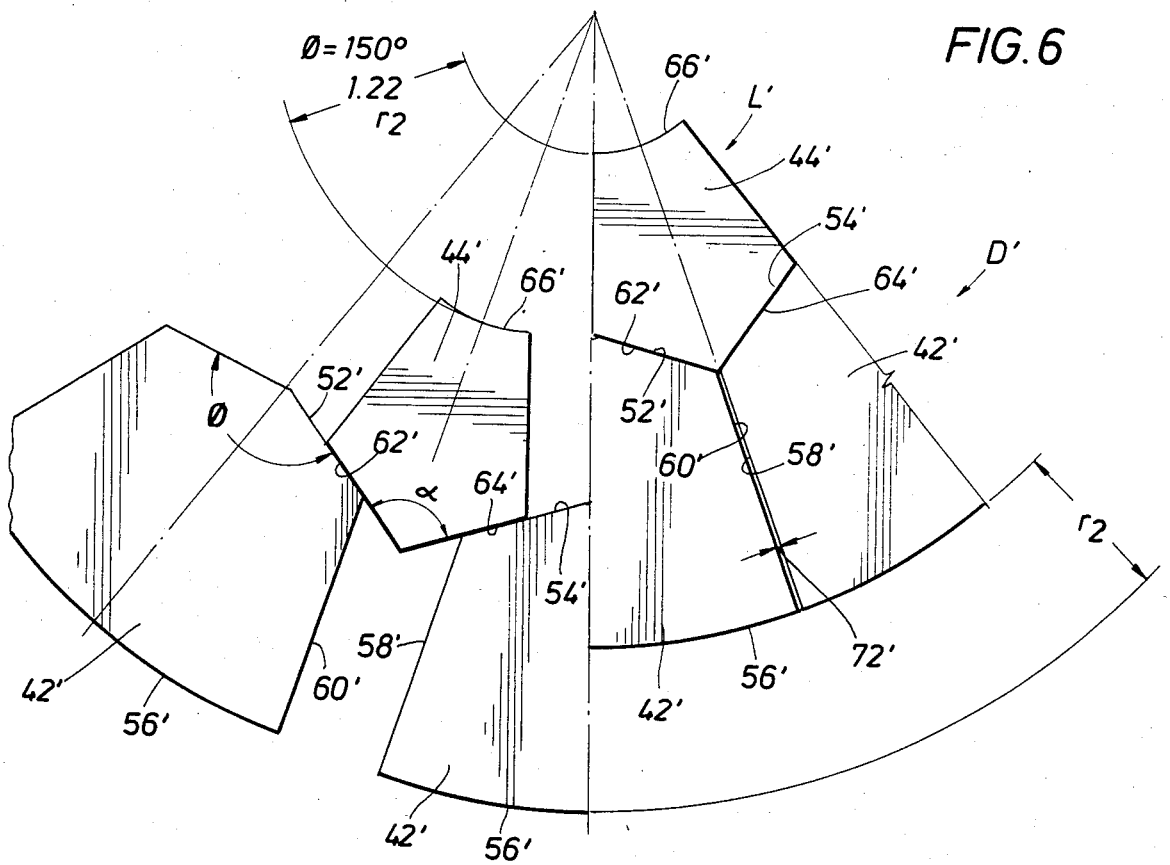
FIG. 6 is a drawing similar to that of FIG. 5 but illustrating a larger angle $\phi$ and showing the packing unit in a relaxed state and in a closed state.

FIG. 6 illustrates the packing unit construction where drive angle $\phi$ of the top plate 42' of a drive insert D' is about 150°. Since $\phi=\alpha+45°$ for eight drive inserts, lead angle $\alpha$ is approximately 105°. The illustration on the right hand side of FIG. 6 illustrates the packing unit in the closed state and illustrates that the top plate 42' drive inserts have moved a distance of $r_2$ whereas the top plate 44' of the lead insert L has moved 1.22 times $r_2$. Thus the packing unit of FIG. 6 requires more stroke of the piston 15 to close the packing unit as compared to that of FIG. 5. The amount of stroke necessary for closing the packing unit may be adjusted by adjusting its drive angle $\phi$. As a result, the packing unit according to the invention may be designed to achieve the advantages of this invention in a replacement packing unit for standard height, existing annular blowout preventers.

As illustrated in FIG. 6 only a small gap 72' exists between the side surfaces 60' and 58' of adjacent top plates 42' of drive inserts D'.

FIG. 7 illustrates in a complete cross section an annular packer unit 100' constructed with an angle $\phi$ approximately equal to 150°. The top plates of the drive inserts are designated 42'; the top plates of the lead inserts are designated 44'.

FIG. 8 illustrates the closed state of the annular packing unit 100' of FIG. 7. More stroke of the piston 15 is required to put the annular packing unit 100' into the closed state as evidenced by the fact that the outer surfaces 56' have moved further inwardly when compared to those of FIG. 4.

FIG. 9 illustrates a side view of the drive insert D. The rear surface 56 of the top plate 42 extends longitudinally downwardly a much greater distance than does the top plate 44 of the lead insert as illustrated in FIG. 13. The extended downward rear surface 56 of the top plate 42 of the drive unit D in cooperation with its angular extent on closure, as illustrated in FIG. 4, leaves only a small gap 72 between adjacent top plates of the drive inserts and provides extensive coverage of the area behind the lead inserts. Such coverage allows the lead inserts to be driven into a smaller diameter without opening the backside of the packing unit to elastomeric extrusion, thereby minimizing outer diameter damage.

Minimizing elastomeric extrusion to the outer rear surface 23 (FIG. 1) of packer 100 minimizes elastomeric wear and tearing off on each closing of the packer with the result that packer cycle life is lengthened. Providing even more protection for the back side of the packer unit are the flared portions 73, as illustrated in FIGS. 9 and 10.

Bottom plate 51 is provided at the end of web 47 of the drive insert D. The reverse slope 110 of the top leading edge of the web 47 provides further increases in packer cycle life as disclosed in U.S. patent application Ser. No. 670,132 assigned to the same assignee of the present application and which is hereby incorporated by reference for all purposes.

FIGS. 11 and 12 further illustrate the construction of the drive insert D.

FIGS. 13 and 14 illustrate a side view and a rear view, respectively, of the lead insert according to the invention. The leading edge 112 is likewise sloped outwardly from top to bottom as disclosed in above U.S. patent application Ser. No. 670,132.

FIGS. 15 and 16 illustrate further details of the construction of the lead insert L.

Various modifications and alterations in the described structures will be apparent to those skilled in the art of the foregoing description which does not depart from the spirit of the invention. For this reason these changes are desired to be included in the appended claims. The appended claims recite the only limitation to the present invention in the description manner which is employed setting forth the embodiments and is to be interpreted as illustrative and not limitative.

What is claimed is:

1. An annular blowout preventer packer unit having a longitudinal axis and adapted to be compressed radially inwardly from a relaxed state to a closing state comprising, an annulus of elastomeric material, metallic drive inserts embedded in said elastomeric material generally circularly about said axis, each of said drive inserts having a web which extends generally longitudinally and having a top plate with two longitudinal forward surfaces and a longitudinal back surface, said two longitudinal forward surfaces being equally inclined with respect to a longitudinal plane along a radius through the center of the drive insert, lead inserts embedded in said elastomeric material generally circularly about said axis, each of said inserts having a web which extends generally longitudinally and having a top plate with two longitudinal rearward surfaces and a longitudinal forward surface, said two longitudinal rearward surfaces being equally inclined with respect to a longitudinal plane through a radius through the center of the lead insert, and said drive inserts and said lead inserts being arranged with respect to each other so that at least partial engagement exists between each forward surface of the top plate of a drive insert and a corresponding rearward surface of the top plate of an adjacent lead insert in the relaxed state of the packer unit.

2. The packer unit of claim 1 wherein a drive angle $\phi$ between said two longitudinal forward surfaces of said top plate of said drive inserts is selected to cause continuous partial engagement between each forward surface of the top plate of a drive insert and the corresponding rearward surface of the top plate of an adjacent lead insert between the relaxed state of the packer unit and the closing state of the packer unit.

3. The packer unit of claim 1 wherein a drive angle $\phi$ between said two longitudinal forward surfaces of said top plate of said drive inserts and a lead angle $\alpha$ between said two longitudinal rearward surfaces of said top plate of said lead inserts is related by the equation $$\phi = \alpha + \frac{360°}{N},$$

where N is the number of drive inserts.

4. The packer unit of claim 3 wherein where N=8 and $\phi$ is selected to be about 90°, the longitudinal forward surfaces of said top plate of said drive inserts are in continuous partial engagement with the corresponding rearward surface of the top plate of an adjacent lead insert between the relaxed state of the packer unit and the closing state of the packer unit, and the lead insert moves radially inwardly approximately 1.85 times as much as does said drive insert during closure of said packer unit.

5. The packer unit of claim 3 wherein where N=8 and $\phi$ is selected to be greater than about 150°, the longitudinal forward surfaces of said top plate of said drive inserts become disengaged with the corresponding rearward surface of the top plate of an adjacent lead insert between the relaxed state of the packer unit and the closing state of the packer unit, and the lead insert moves radially inwardly approximately 1.22 times as much as does said drive insert during closure of said packer unit.

6. The packer unit of claim 1 wherein said longitudinal rear surface of said top plate of said drive insert is curved.

7. The packer unit of claim 1 wherein said longitudinal forward surface of said top plate of said lead insert is curved.

8. The packer unit of claim 6 wherein said curved rearward longitudinal surface of said top plate of said drive inserts is approximately $$\frac{2\pi}{N}$$

times the outer radius of the top plate of the drive insert of the packer unit on complete closure, where N is the number of drive inserts in the packer unit, whereby when the packer unit is completely closed, only a small gap exists between adjacent rearward longitudinal surfaces, operably substantially preventing radial extrusion of elastomeric material between said drive insert top plates of said packing unit during closure.

9. The packer unit of claim 8 wherein each of said top plates of said drive inserts have two longitudinal side surfaces, each of said side surfaces connecting one end of said rearward curved surface with one of said inclined forward surfaces, whereby when the packer unit is completely closed, only a small gap exists between adjacent side surfaces of said drive inserts, operably substantially preventing upward elastomeric extrusion between said top plates of said drive inserts.

10. The packer unit of claim 7 wherein said curved forward surface of said top plate of said lead insert is approximately $$\frac{2\pi}{N}$$

times the inner radius of the top plate of the lead insert of the packer unit on complete closure, where N is the number of lead inserts in the packer unit, whereby when the packer unit is completely closed, only a small gap exists between adjacent forward longitudinal surfaces, operably substantially creating a solid metallic wall about the longitudinal axis of the packer unit and preventing radial extrusion of elastomeric material through said lead insert top plates.

11. The packer unit of claim 10 wherein each of said top plates of said lead inserts have two longitudinal side surfaces, each side surfaces connecting one end of said forward curved surface with one of said inclined longitudinal rearward surfaces, whereby when the packer unit is completely closed, only a small gap exists between adjacent side surfaces of said lead inserts, operably substantially preventing upward elastomeric extrusion between said top plates of said lead inserts.

12. The packer unit of claim 1 wherein said rear surface of said top plate of said drive inserts extends downwardly further than said two longitudinal forward surfaces, operably hindering rearward radial extrusion of elastomeric material on closure.

13. The packer unit of claim 12 wherein each of said drive inserts includes a flared portion along the back of said web from a point approximately midway of the longitudinal extent of said web upwardly to said rear surface of said top plate, said flared portion further operably hindering rearward radial extrusion of elastomeric material on closure.

14. The packer unit of claim 1 wherein each of said drive inserts has a bottom plate with two longitudinal forward surfaces, said two longitudinal forward surfaces being equally inclined with respect to the longitudinal plane along the radius through the center of the drive insert, said lead inserts having a bottom plate with two longitudinal rearward surfaces and a longitudinal forward surface, said two longitudinal rearward surfaces being equally inclined with respect to a longitudinal plane through a radius through the center of the lead insert, and said drive inserts and said lead inserts being arranged with respect to each other so that at least partial engagement exists between each forward surface of the bottom plate of a drive insert and a corresponding rearward surface of the bottom plate of an adjacent lead insert in the relaxed state of the packer unit.

15. An annular blowout preventer packer unit having a longitudinal axis and adapted to be compressed radially inwardly from a relaxed state to a closing state comprising, an annulus of elastomeric material, metallic drive inserts embedded in said elastomeric material generally circularly about said axis, each of said drive inserts having a web which extend generally longitudinally and having a top plate with two longitudinal forward surfaces and a longitudinal back surface, said two longitudinal forward surfaces being equally inclined with respect to a longitudinal plane along a radius through the center of the drive insert, said drive inserts having a bottom plate with two longitudinal forward surfaces, said two longitudinal forward surfaces being equally inclined with respect to the longitudinal plane along the radius through the center of the drive insert, lead inserts embedded in said elastomeric material generally circularly about said axis, each of said inserts having a web which extends generally longitudinally and having a top plate with two longitudinal rearward surfaces and a longitudinal forward surface, said two longitudinal rearward surfaces being equally inclined with respect to a longitudinal plane through a radius through the center of the lead insert, said lead inserts having a bottom plate with two longitudinal rearward surfaces and a longitudinal forward surface, said two longitudinal rearward surfaces being equally inclined with respect to the longitudinal plane through the radius through the center of the lead insert, and said drive inserts and said lead inserts being arranged with respect to one another so that at least partial engagement exists between each forward surface of the top plate of a drive insert and a corresponding rearward surface of the top plate of an adjacent lead insert in the relaxed state of the packer unit and partial engagement exists between each forward surface of the bottom plate of the drive insert and a corresponding rearward surface of the bottom plate of an adjacent lead insert in the relaxed state of the packer unit.

* * * * *